US005911744A

United States Patent [19]

Kawaguchi

[11] Patent Number: 5,911,744

[45] Date of Patent: Jun. 15, 1999

[54] REFRIGERATING METHOD AND APPARATUS FOR SHOWCASES AND VENDING MACHINES AS WELL AS OPEN TYPE SHOWCASES AND VENDING MACHINES UTILIZING SAID METHOD AND APPARATUS

[75] Inventor: Hirofumi Kawaguchi, Fuchu, Japan

[73] Assignee: Nihon Techno Co., Ltd., Tokyo, Japan

[21] Appl. No.: 08/868,447

[22] Filed: Jun. 3, 1997

Related U.S. Application Data

[63] Continuation of application No. 08/431,658, May 2, 1995, abandoned.

[30] Foreign Application Priority Data

| | | | |
|---|---|---|---|
| Jun. 23, 1994 | [JP] | Japan | 6-141909 |
| Aug. 24, 1994 | [JP] | Japan | 6-199761 |
| Dec. 22, 1994 | [JP] | Japan | 6-320926 |

[51] Int. Cl.[6] ..... A47F 3/04

[52] U.S. Cl. ..... 62/89; 62/255; 62/237; 62/434

[58] Field of Search ..... 62/89, 188, 255, 62/237, 434, 435

[56] References Cited

U.S. PATENT DOCUMENTS

| | | | |
|---|---|---|---|
| 2,779,171 | 1/1957 | Lindenblad | 62/434 |
| 3,156,101 | 11/1964 | McGuffey | 62/434 |
| 3,777,506 | 12/1973 | Hergatt et al. | 62/237 |
| 4,011,735 | 3/1977 | Martz et al. | 62/186 |
| 4,210,000 | 7/1980 | Lee . | |
| 4,632,019 | 12/1986 | Whiteman | 62/237 |
| 4,901,538 | 2/1990 | Anthony | 62/237 |
| 4,936,103 | 6/1990 | Newman | 62/89 |
| 5,086,627 | 2/1992 | Platt . | |
| 5,315,837 | 5/1994 | Lego | 62/89 |

FOREIGN PATENT DOCUMENTS

| | | |
|---|---|---|
| 3002261 | 7/1981 | European Pat. Off. . |
| 0379460 | 7/1990 | European Pat. Off. . |
| 2201676 | 7/1973 | Germany . |
| 2648237 | 5/1977 | Germany . |
| S52-56431 | 5/1977 | Japan . |
| S56-87774 | 7/1981 | Japan . |
| S56-91166 | 7/1981 | Japan . |
| S56-97766 | 8/1981 | Japan . |
| S56-110864 | 9/1981 | Japan . |
| S59-65384 U | 5/1984 | Japan . |
| S62-149764 U | 9/1987 | Japan . |
| H1-160290 U | 11/1989 | Japan . |
| H3-127893 U | 12/1991 | Japan . |
| H6-3338 | 1/1994 | Japan . |
| H6-318285 | 11/1994 | Japan . |

*Primary Examiner*—William E. Tapolcai
*Attorney, Agent, or Firm*—Koda & Androlia

[57] ABSTRACT

Method for refrigerating showcases characterized by the steps of cooling air within a refrigerating unit to a temperature below the predetermined temperature in showcases and feeding said cooled air as refrigerating source into said showcases through feeding piping; mixing said cooled air with air in said showcases thereby to carry out refrigerating in said showcases while collecting said air in said showcases in the same quantity of said cooled air fed into said showcases through collecting piping into said refrigerating unit; and cooling said collected cooled air in said refrigerating unit for using again said collected and cooled air as refrigerating air.

The refrigerating device according to the invention has lower initial and running costs and can effectively utilize the internal space of showcases and automatic vending machines for goods containing use.

13 Claims, 9 Drawing Sheets

REFRIGERATING METHOD AND APPARATUS FOR SHOWCASES AND VENDING MACHINES AS WELL AS OPEN TYPE SHOWCASES AND VENDING MACHINES UTILIZING SAID METHOD AND APPARATUS

This application is a continuation of application Ser. No. 08/431,658, filed May 2, 1995, now abandoned.

BACKGROUND OF THE INVENTION

This invention relates to refrigerating method and refrigerating apparatus of showcases for foodstuff displaying use or goods containing cases of automatic vending machines and the like, more specifically method and apparatus being suitable especially for refrigerating of cold storage or refrigerating showcases installed for example in large scale markets, as well as open type showcases and vending machines utilizing said refrigerating method and apparatus.

Nowadays when the scale-up of foodstuff shops or markets is advancing due to lightening of the Large Scale Shops Regulation, production of refrigerated or chilled foodstuff is more and more increased in our foodstuff industry. As a result, showcases for refrigerated foodstuff and cold-storage foodstuff (these showcases for refrigerated and/or cold-storage foodstuff being called hereunder "showcases") are occupying more and more proportion of the available floor surface of these shops.

These showcases are to refrigerate or cold-store the foodstuff contained therein by means of cold air refrigerated through refrigerating units constituting a refrigerating circuit. The refrigerating units comprise various members such as a compressor, a condenser, expanding members and an evaporator constituting a refrigerating cycle and connected to each other through a piping in which a coolant is circulated, and a fan serves to carry out heat-exchange between coolant in the evaporator and surrounding medium for refrigerating said medium.

The operation of the refrigerating cycle is as follows:

Coolant is first absorbed into the compressor and compressed therein to a condition of high temperature—high pressure. Coolant in this condition is forced to pass through a condenser such as for example capillary tubes and wherein coolant is subjected to heat-exchange with surrounding air thereby to cause the medium to radiate and liquefy. Liquid coolant thus obtained is subjected to adiabatic expansion at expansion members such as expansion valve thereby to be changed into liquid condition of low temperature—low pressure. Coolant in this liquid condition is caused to pass through the evaporator to absorb heat from surrounding medium to be refrigerated, thereby to refrigerate said surrounding medium while at the same time evaporating itself to return to its initial gas condition. Then coolant in its gas condition is again absorbed into the condenser for continuing the refrigerating cycle.

The refrigerating apparatus of conventional showcases is now explained below.

The conventional showcases installed in the shops contained therein the above described expansion members, evaporator, fans and various controllers. On the other hand, said compressor with its driving motor was set in a machinery room set outdoor, and said condenser was set in a ventilated place such as on the roof. These compressor and condenser installed outdoor and said expansion members and evaporator contained in each showcase were connected each other through a plurality of (coolant) pipings.

In particular, for connecting said compressor to various mechanical members, use was made of a plurality of pipings which were to be laid so as to connect branches from the side of said compressor to each showcase while preventing leakage of coolant therefrom. Connecting means for the pipings consisting of copper pipes were welding between adjacent pipes or mechanical joint members such as screw. Further, the outer surface of each pipe was covered by adiabatic members.

In the above refrigerating device, high temperature—high pressure coolant fed from said compressor through said pipings was caused to evaporate in the evaporator contained in the showcase to cause heat-exchange with air in the goods displaying portion of the showcase thereby to refrigerate these goods.

Since temperature of the surface of evaporator for carrying out heat-exchange with air in the goods displaying portion in the showcase is generally below ice point, frost is formed on the surface of evaporator. Consequently, frost removing operation called "Defrosting" was carried out at the frequency of one time for 3–4 hours. This defrosting operation is to remove frost on the surface of evaporator by interruption of cooling cycle in the showcase. Therefore, a drain pipe had to be set in each showcase for draining waste water resulting from said defrosting operation.

The installation of showcases needs various large works such as coolant pipings, covering of adiabatic members on the pipings, and drain piping for each showcase as well as electrical operation for feeding electricity to each showcase. As a result, once installed, the showcases could not be shifted easily due to the drain pipes and electrical distributing cables, and the replacement of showcases were fairly expensive work.

When the connection of said pipings were carried out through welding in said coolant piping works, there was a risk of pipe damages under excessive charges applied to the connection due to any outer shocks. In the case of screw connection of said pipings, contraction of pipes such as copper pipe due to variation of temperature caused loosening of screws. In any case, leakage of coolant such as freon gas generates serious environmental problems since freon gas causes the destruction of ozone layer. Further, since the number of connections of said pipings were increased together with the number of showcases, with the result of higher leakage of coolant and more complicated maintenance works.

Further, when the above described defrosting has been carried out for removing frost deposited on the evaporator, it was inevitable that the temperature in showcase was increased by 10–15 degrees centigrade. But the increase of temperature caused generally the problems of quality control such as drip dropping or so called "dripping" of raw meat or raw fish maintained in a chilled condition. On the other hand, in the event of trouble with machines in the showcase, repairing works must have been done in the shop with corresponding business delay.

On the other hand, concerning to a large number of vending machines located all over the country and having each refrigerating unit therein, problems similar to those of showcases have occurred especially when a plurality of such vending machines were installed in the same place.

Moreover, the conventional showcase installed in the shop has a goods take-out port which is opened on the front surface thereof. Cooled air in the showcase flows out through the port and the cooled air stays on the passage in front of the showcase. Accordingly, the cooling efficiency of the showcase is bad and a person who passes by the showcase or takes out some goods from the showcase feels cold on his feet.

SUMMARY OF THE INVENTION

For eliminating the above disadvantages, the invention has as its object to deliver refrigerating method and apparatus for showcases and vending machines as well as open type showcases and vending machines utilizing said method and apparatus, said showcase and vending machines having lower running cost and lower initial cost and permitting to efficiently use their internal space for goods containing.

For achieving the object described above, according to claim 1, the method for refrigerating showcases of the invention comprises: cooling air within a refrigerating unit to a temperature below the predetermined temperature in showcases and feeding said cooled air as refrigerating source into said showcases through feeding piping; mixing said cooled air with air in said showcases thereby to carry out refrigerating in said showcases, while at the same time collecting said air in said showcases in the same quantity of said cooled air fed into said showcases as refrigerating source through collecting piping back into said refrigerating unit; and cooling said collected cooled air in said refrigerating unit for using again said collected and cooled air as refrigerating air.

According to claim 2, method for refrigerating showcases described in claim 1 further comprises controlling each of automatically air flow volume regulating means provided respectively in the feeding side and in the collecting side of each showcase corresponding to the temperature in each of said showcases; and regulating supplying and collecting volume of cooled air proportionally.

According to claim 3, refrigerating device for showcases comprises: a plurality of showcases having respectively cooled air ejecting port and cooled air absorbing port; a refrigerating unit located separately from said showcases and consisting of a refrigerating cycle having a compressor, a condenser, expansion members and an evaporator; a feeding piping for feeding cooled air generated from said refrigerating unit into said respective showcases through said cooled air ejecting port; and a collecting piping for collecting said cooled air from said respective showcases through said cooled air absorbing port thereof back into said refrigerating unit.

According to claim 4, refrigerating device comprises: a plurality of showcases having respectively cooled air ejecting port or ports and cooled air absorbing port or ports; a refrigerating unit located separately from said showcases and consisting of a refrigerating cycle having a compressor, a condenser, expansion members and an evaporator, of cold storage tank for cold storing of circulated brine, and of a cooled air generating chambers having each heat exchangers therein for heat exchanging said brine cold stored in said cold storage tank with air thereby to generate cooled air for respective showcases; a feeding piping for feeding cooled air generated from said refrigerating unit into said respective showcases through said cooled air ejecting port; and a collecting piping for collecting said cooled air from said respective showcases through said cooled air through said heat exchangers in said cooled air generating chamber.

According to claim 5, refrigerating device described in claim 4 further comprises: opening and shutting means provided in each of said feeding piping and said collecting piping and regulating the opening degree of said feeding piping or said collecting piping for presetting the feeding cooled air volume or the collecting cooled air volume fixed; and at least one automatically air flow volume regulating devices provided respectively in the feeding side and in the collecting side of each showcase to regulate supplying and collecting volume of cooled air proportionally by means of temperature controlling devices located in said respective showcases.

According to claim 6, refrigerating device of showcases described in claim 4 or claim 5 further comprises: sealed vessels for sealing freezable brine therein provided in said cold storage tank.

According to claim 7, refrigerating device of showcases described in either of claim 3 to claim 6 further comprises: said feeding piping and said collecting piping consisted respectively of cylindrical adiabatic vent pipes, pairs of adjacent adiabatic vent pipes connected by means of connecting members inserted respectively into edge portions of said adjacent adiabatic vent pipes.

According to claim 8, refrigerating device of showcases described in either of claim 3 to claim 7 further comprises: said feed piping and said collecting piping having respectively thereon at least a valve having duct opening regulation function for regulating the opening degree of said respective pipings in order to fix the venting capacity of said cooled air to be fed and said cooled air to be collected to predetermined values, and flow rate controlling function for automatically controlling the flow rate of ducts by means of temperature controlling devices located in said respective showcases.

According to claim 9, refrigerating device of showcases described in either of claim 3 to claim 8 further comprises: said cooled air generating chamber having therein two heat exchanging chambers independent to each other, said respective heat exchanging chambers having therein said heat exchangers and having thereto connected said collecting piping, whereby said cold brine for refrigerating use and hot brine for defrosting use selectively introduced into said heat exchangers.

According to claim 10, refrigerating device of showcases described in claim 9 further comprises: said cooled air generating chamber having therein a cooled air collecting chamber located adjacent to each of said heat exchanging chambers via a bulkhead and connected to each of said feeding piping, and said bulkhead comprising an opening having shutters for selectively carrying out venting between said heat exchanging chamber and said cooled air collecting chamber.

According to claim 11, method for refrigerating vending machines comprises: cooling air within a refrigerating unit to a temperature below the predetermined temperature in vending machines and feeding said cooled air as refrigerating source into said vending machines through feeding piping; mixing said cooled air with air in said vending machines thereby to carry out refrigerating in said vending machines while collecting said air in said vending machines in the same quantity of said cooled air fed into said showcases as refrigerating source through collecting piping back into said refrigerating unit; and cooling said collected cooled air in said refrigerating unit for using again said collected and cooled air as refrigerating air.

According to claim 12, refrigerating device for vending machines comprises: a plurality of vending machines having respectively cooled air ejecting port and cooled air absorbing port; a refrigerating unit located separately from said vending machines and having a compressor, a condenser, expansion members and an evaporator so as to form a refrigerating cycle; a feeding piping for feeding cooled air generated from said refrigerating unit into said respective vending machines through said cooled air ejecting port; and a collecting piping for collecting said cooled air from said respective vending machines through said cooled air absorbing port thereof into said refrigerating unit.

According to claim 13, refrigerating device of vending machines described in claim 12 further comprises: said feeding piping and said collecting piping consisted respectively of cylindrical adiabatic vent pipes, pairs of adjacent adiabatic vent pipes connected by means of connecting members inserted into edge portions of said adjacent adiabatic vent pipes.

According to claim 14, refrigerating device of vending machines described in claim 12 or claim 13 further comprises: said feeding piping and said collecting piping having respectively thereon at least a valve having duct opening regulation function for regulating the opening degree of said respective pipings in order to fix the venting capacity of said cooled air to be fed and said cooled air to be collected to predetermined values, and flow rate controlling function for automatically controlling the flow rate of said cooled air by means of temperature controlling devices located in each of said vending machines.

According to claim 15, open showcase comprises: a goods display section on the inside of an open goods taking-out opening; a cooled air feeding port communicating with said goods display section for feeding cooled air from outside into said goods display section; and a cooled air collecting port communicating with said goods display section for collecting said cooled air in order to exhaust it outwards thereby to prevent the leakage of said cooled air from said goods taking-out opening.

According to claim 16, open showcase described in claim 15 further comprises: air flow rate controlling means for substantially equalizing respective flow rates of cooled air fed from said cooled air feeding port and of cooled air collected from said cooled air collecting port; and an automatic controlling means of cooled air circulation while comparing the temperature in said goods display section with respect to a predetermined temperature; whereby to stop the feeding of cooled air to said cooled air feeding port and the collecting of cooled air from said cooled air collecting port when said temperature in said goods display section has fallen below said predetermined temperature as well as to start again the feeding of cooled air to said cooled air feeding port and the collecting of cooled air from said cooled air collecting port when said temperature in said goods display section has arisen above said predetermined temperature.

Described in claim 17, vending machines comprises: a goods containing box formed inside of goods taking out opening in its opening condition; a cooled air feeding port communicating with said goods containing box for feeding cooled air from outside into said goods containing box; a cooled air collecting port communicating with said goods display section for collecting said cooled air in order to exhaust it outwards; whereby to prevent the leakage of said cooled air from said goods taking-out opening.

According to claim 18, vending machines described in claim 17 further comprises: air flow rate controlling means for substantially equalizing respective flow rates of cooled air fed from said cooled air feeding port and of cooled air collected from said cooled air collecting port; and an automatic controlling means of cooled air circulation while comparing the temperature in said goods containing box with respect to a predetermined temperature; whereby to stop the feeding of cooled air to said cooled air feeding port and the collecting of cooled air from said cooled air collecting port when said temperature in said goods display section has fallen below said predetermined temperature as well as to start again the feeding of cooled air to said cooled air feeding port and the collecting of cooled air from said cooled air collecting port when said temperature in said goods display section has arisen above said predetermined temperature.

When using refrigerating method and refrigerating device according to the invention, cooled air in respective showcases is introduced into said refrigerating unit through said collecting piping, wherein said cooled air is further cooled by heat exchanging with coolant in said evaporator or with brine in said heat exchangers. This air further cooled is fed to respective showcases through said feeding piping, so that foodstuffs displayed in respective showcases can be refrigerated without the need of installing equipments constituting refrigerating cycle in respective showcases. Foodstuffs contained in vending machines can be similarly refrigerated.

DETAILED DESCRIPTION OF THE EMBODIMENTS

The method and refrigerating device according to the invention is described hereinbelow referring to the attached drawings.

Figure 1:
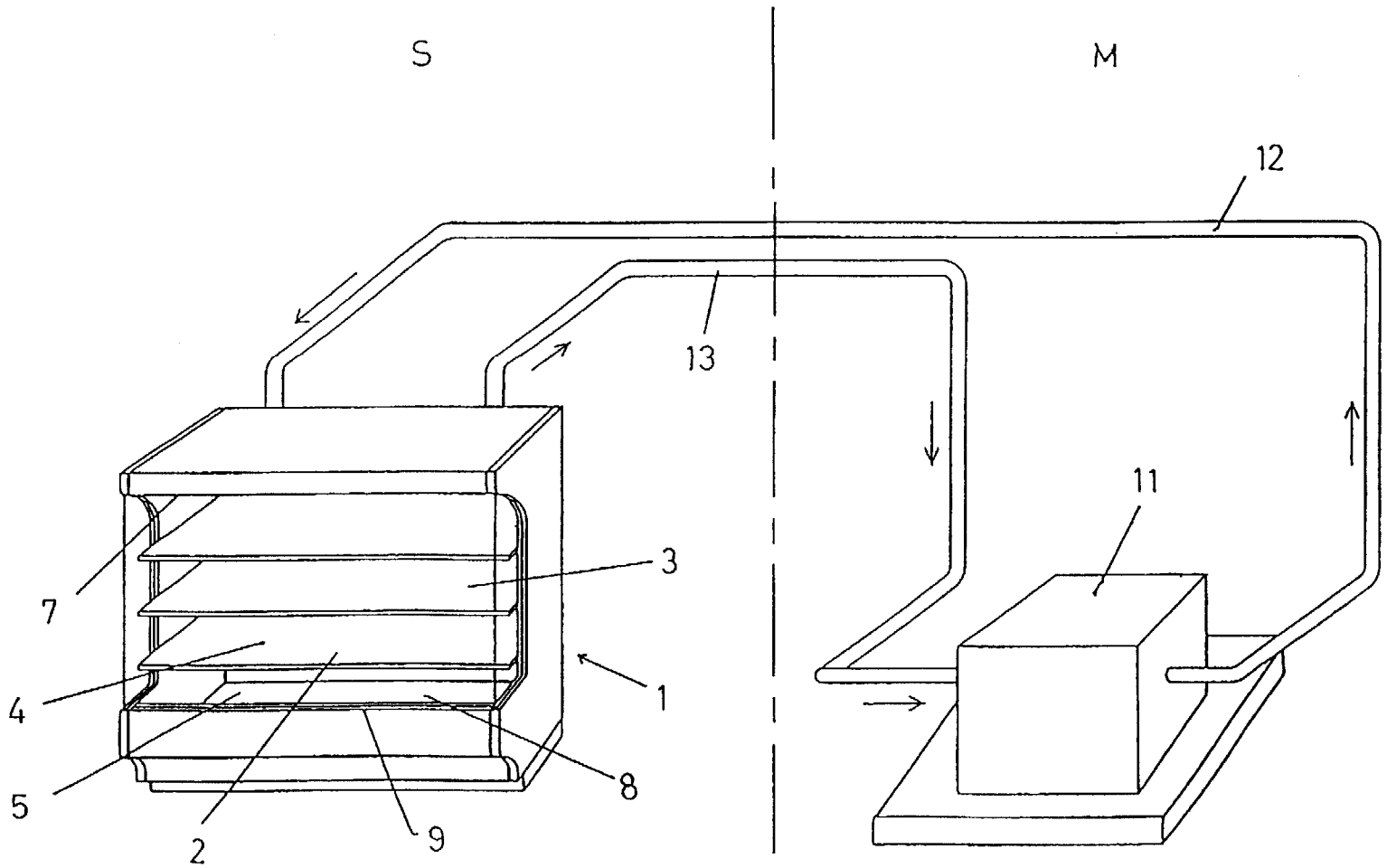
FIG. 1 is a diagram showing the first embodiment of refrigerating device of showcase according to the invention.
Figure 2:
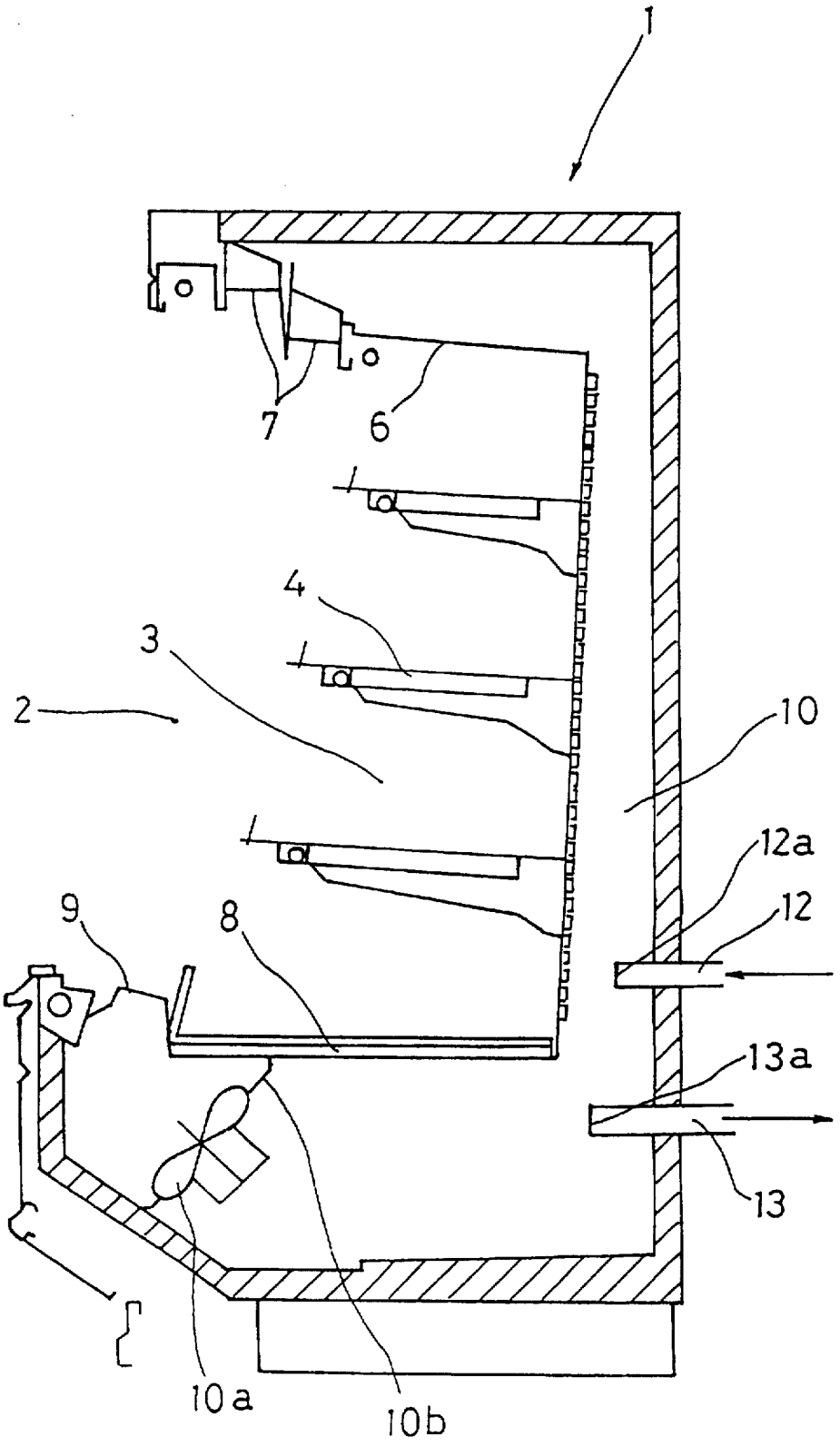
FIG. 2 is a longitudinal cross section of the first embodiment of showcase.

FIG. 1 is a diagram of refrigerating device of showcase according to the invention. As shown in the diagram, a plurality of showcases 1 is installed in a shop S, with only a representative showcase 1 shown in FIG. 1. Said showcase 1 is a so called "open showcase" referred to herein later simply "showcase" unless otherwise specified and which is built as box type having a part of its front surface opened as goods taking-out port 2. A goods display section 3 is formed so as to communicate with said port 2. In said goods display section 3, a plurality of detachable shelves 4,4 . . . are located with vertical distances therebetween. A goods containing box 5 as good displaying section is located at the bottom of said goods display section 3 as a portion thereof. As is clear from the drawings, machines or members used in the known showcases such as condenser, expansion members, evaporator and the like are not located in the showcase 1, and no water pipe for collecting drain water is not connected therein. Further, the design of said goods display section 3 is not limited to that shown in FIG. 2.

A cooled air ejecting ports 7 are located on the front portion of upper wall 6 of said goods display section 3, while an absorbing port 9 for collecting air used for cooling goods in said display section 3 is formed on the front portion of lower wall 8, and this absorbing port 9 is communicated with air passage 10 formed at the back of said display section 3.

End portion 12*a* of a cooled air feeding pipe 12 is located through the rear wall of said showcase 1 to communicate with the middle portion of said air passage 10. A baffle plate 10*b* with a fan 10 is located near said cooled air absorbing port 9 to communicate with said air passage 10. End portion 13*a* of a cooled air collecting pipe 13 is located through the rear wall of said showcase 1 at the middle position between said fan 10*a* and said end portion 12*a* of said cooled air feeding pipe 12.

Now referring to FIG. 1, in a machinery room M isolated from said shop S having said showcase 1 contained therein, a refrigerating unit 11 is set for refrigerating said goods containing box 5 of said each showcase 1. Said refrigerating unit 11 comprises the elements constituting the refrigerating cycle, such as compressor, expansion members and evaporator as well as motors for driving said compressor. A condenser is located at a not-shown ventilated outdoor location. Said compressor and motor can be isolated from said expansion members, evaporator and thelike in said machinery room M.

A feeding pipe 12 is connected to said refrigerating unit 11 for feeding cooled air generated through heat exchange with coolant of said evaporator in said refrigerating unit 11 to said goods containing box 5 of said each showcase 1. As described above, the end portion 12*a* of said feeding pipe 12 is connected to said air passage 10 of each showcase. Further, said cooled air collecting pipe 13 communicating with said air passage 10 in each showcase 1 is connected to said refrigerating unit 11 for collecting or recovering used air in said air passage 10 of each showcase 1. For establishing a circulation of cooled air between said refrigerating unit 11 and each showcase 1 through said feeding pipe 12 and collecting pipe 13, a fan 61 of big capacity for air feeding and another not-shown fan of big capacity for air collecting are located in said refrigerating unit 11.

Said air feeding pipe 12 and air collecting pipe 13 comprise respectively a plurality of adiabatic vent pipes 14 connected to each other. Each of said adiabatic vent pipes 14 has a cylindrical body 15 of foamed adiabatic material such as urethane. A cylindrical core 16 of resins such as polyvinyl chloride and the like is inserted into said body 15 along its internal surface for the purpose of reducing air resistance. A cylindrical connecting member 17 of polyvinyl chloride and the like resins is inserted into the end of said body 15 along its internal surface so as to connect with said core 16. By connecting respective end portions of adjacent adiabatic vent pipe 14, 14 by means of connecting member 17 inserted into said end portions and adhered thereto, said continuous feeding pipe 12 and collecting pipe 13 are formed. Further, it is preferable to seal the outer surface of connection between adjacent adiabatic vent pipes 14, 14 by means of not-shown adhesive tape and the like. A preferred example of said vent pipe body 15 has a length of 1–1.2 m, an inner diameter of 50–600 cm, a thickness of wall of 30–75 mm, more preferably 50–75 mm, but it is noted that these various sizes are different between the trunk pipe on the side of refrigerating unit 11 and the branch pipes on the side of showcases 1. Further, the thickness of said body 15 must be preferably thicker for lower temperature of cooled air.

Figure 3:
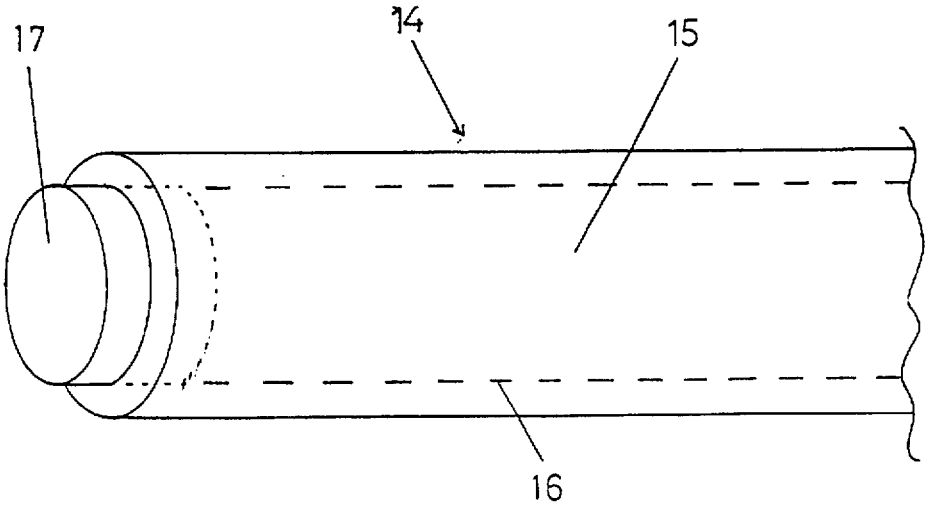
FIG. 3 is a perspective view of an adiabatic venting pipe according to the invention.
Figure 4:
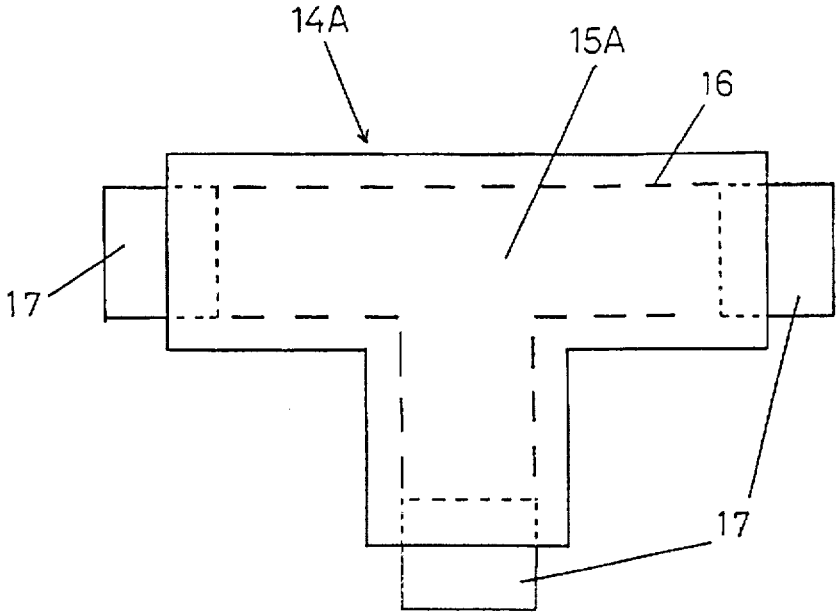
FIG. 4 is a plan view of another type of adiabatic venting pipe according to the invention.

On the other hand, at the branching or concentrating connections, a adiabatic vent pipe 14A of T form as shown in FIG. 4, or a not-shown L pipe or 45 L pipe may be used. Similarly to said adiabatic vent pipe 14, this adiabatic vent pipe 14A and other formed adiabatic vent pipe have a body 15A of foamed adiabatic material such as urethane, said body having therein a cylindrical core 16 A similar to said core 16. Said adiabatic vent pipe 14A can be connected with other adiabatic vent pipe 14, 14A by use of connecting member 17A similar to said connecting member 17 of FIG. 3.

While connecting members 17 are attached to all three end portions of the adiabatic vent pipe 14 shown in FIG. 4, these connecting members 17 connect with corresponding end portions of other adiabatic vent pipe 14, 14A having no connecting members 17. Of course, the three end portions of said adiabatic vent pipe 14A need not have all corresponding connecting members 17.

Then, said feeding piping 12 for feeding air cooled in said refrigerating unit 11 into said showcases 1 and said collecting piping 13 for collecting air from said showcases 1 are laid so as to build up the circulation between said refrigerating unit 11 and said showcases 1 installed in said shop S. At the pipe laying work of said feeding pipe 12 and collecting pipe 13, connecting members 17 are first inserted into the end portions of adiabatic vent pipe body 15,15A and attached thereto by means of adhesives, and the outer surface of the obtained connection is sealed by means of adhesive tape. Piping 14,14A is to be laid out at the place which does not attract attention and does not impede clients walk or goods handling.

Operation of the embodiment of the invention having structural elements as above is described hereinbelow.

Liquid coolant of low temperature and low pressure generated in refrigerating unit 11 is fed into an evaporator not shown. Air collected from each showcase 1 into said refrigerating unit 11 through said collecting pipe 13 is subjected to heat exchange with liquid coolant passing through said evaporator thereby to cool further the collected air, and the cooled air thus obtained is fed into said feeding pipe 12 by means of fan located in said refrigerating unit 11. Cooled air passing through said feeding pipe 12 is blown out into said goods containing box 5 through said cooled air ejecting ports 7. Since these ejecting ports 7 are set in the upper front portion of said showcase, ejected cooled air flows from the upper portion of said goods display section 3 to the lower portion thereof, while cooling the goods contained therein. Air used for goods cooling is absorbed through said absorbing port 9 by means of said fan 10*a* thereby to be fed into collecting pipe 13 at the rear side of said goods displaying section 3 and finally to be returned to said refrigerating unit 11. As described above, cooled air is caused to circulate between refrigerating unit 11 and each showcase through feeding pipe 12 and collecting pipe 13 thereby to cool goods contained in said goods display section 3 to a predetermined temperature.

Further, desired cooling temperatures are different depending on the cooled goods, for example in general cooling temperature in the order of −25 degrees centigrade being preferable when using said showcase 1 as cold-storage box, temperature in the order of −3 degrees centigrade being preferable for raw foodstuff such as raw meat and raw fish and temperature in the order of 10 degrees centigrade in centigrade being preferable for usual foodstuffs such as milk and bean curd.

Now, two refrigerating units 11, one for cold storage of refrigerated foodstuff and another for double use as cold stooge box of raw foodstuff or refrigerator of usual foodstuff, are prepared, thereby to feed cooled air of desired respective temperatures into a desired showcase 1 either for using this showcase 1 as cold-storage box or as refrigerator. A common compressor can be used even when two types of refrigerating units are used as in this case.

The showcase 1 according to the invention consists of display shelves of simple construction having only said cooled air ejecting ports 7 and said absorbing port 9 and having no evaporator, so that laying of drain pipes, electrical distributing work and coolant pipe laying work are not necessary. As a result, said showcase 1 can be shifted to any desired places. Said adiabatic vent pipes 14,14A connecting said refrigerating unit 11 of said machinery room with said showcase 1 within shop S can be easily laid, and said adiabatic vent pipes 14,14A can be produced at low cost.

Further, according to the invention, the machinery such as expansion members, evaporator and the like which were installed in each conventional showcases are concentrated into said machinery room M wherein refrigerating cycle can be carried out as a whole, so that the number of manufacturing components of showcase itself is reduced with the manufacturing cost reduced considerably. In other words, for installing 100 showcases in the heretofore known technics, respective 100 evaporators, 100 expansion members and the like were needed corresponding to the number of showcases to be installed. On the other hand, according to the invention, only one set of refrigerating unit 11 (for one temperature to be set) in said machinery room M can carry out sufficient functions independently of the number of showcases. Further the simple construction of showcase itself allows for smaller floor space thereof with more efficient utilization of sale floor surface in the shop.

Further, concentration of refrigerating cycle into the machinery room M eliminates the need of laying coolant pipes, drain pipes and electrical distribution lines for each showcase, so that it is possible to reduce the equipment cost and also the running cost such as the operation maintenance cost for preventing any troubles. Laying of coolant pipes is constantly set in machinery room M, so that there is no risk of gas leakage at the shift of showcases 1 as in the conventional shops, and since there is fewer connection points due to considerably shorter lengths of coolant pipes, gas leakage is further reduced. Further, since there is no need to take the pressure loss of coolant in the pipes into capacity planning, production capacity is increased by 25–30%.

Further, said defrosting operation in each showcase is not necessary due to concentrated control in machinery room M, so that a better temperature control in showcases is obtained with no risk of "dripping" and with better quality control of goods.

The first embodiment of the invention described above can be naturally applied to vending machines.

Figure 5:
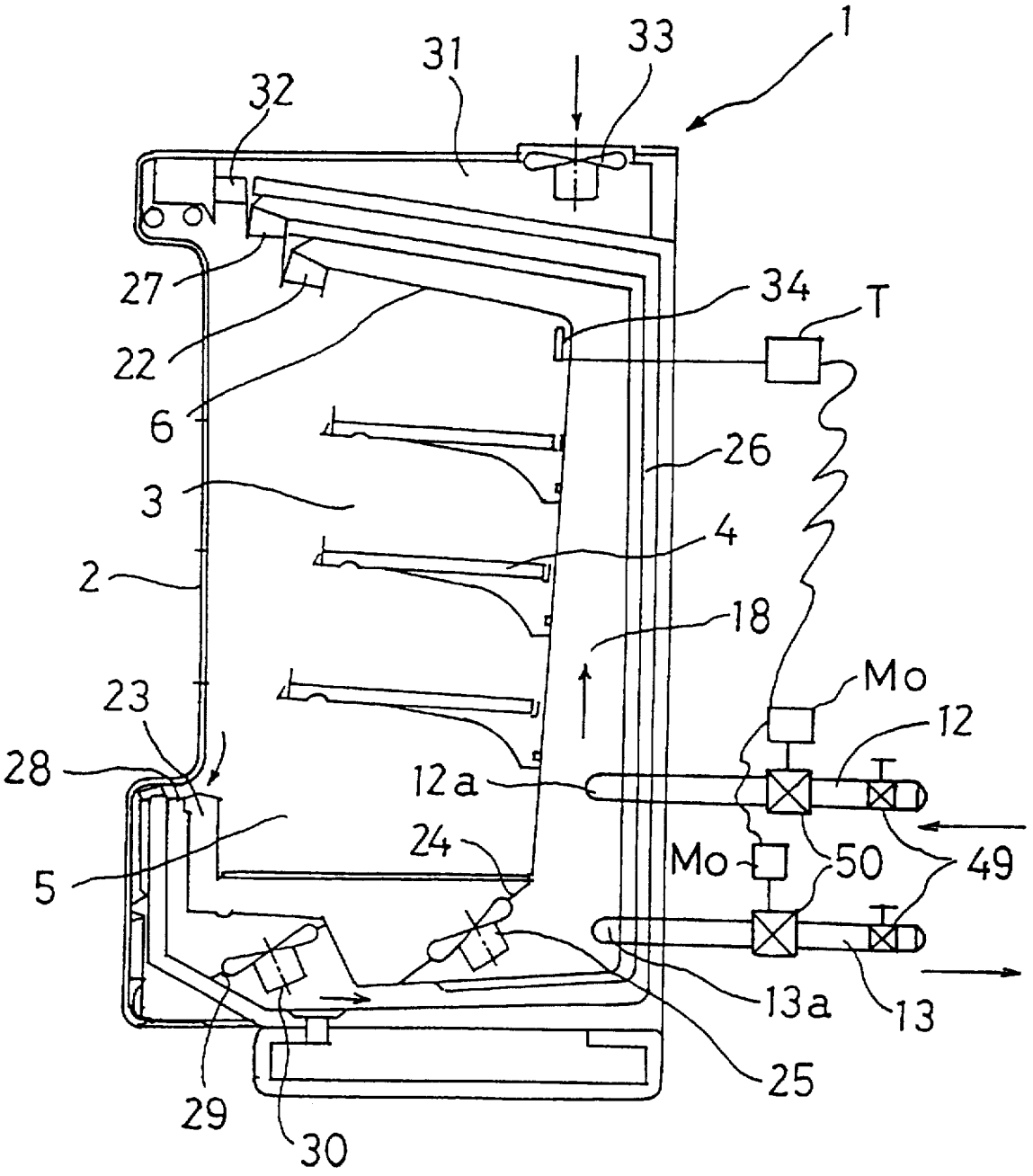
FIG. 5 is a longitudinal cross section of the second embodiment of showcase according to the invention.
Figure 6:
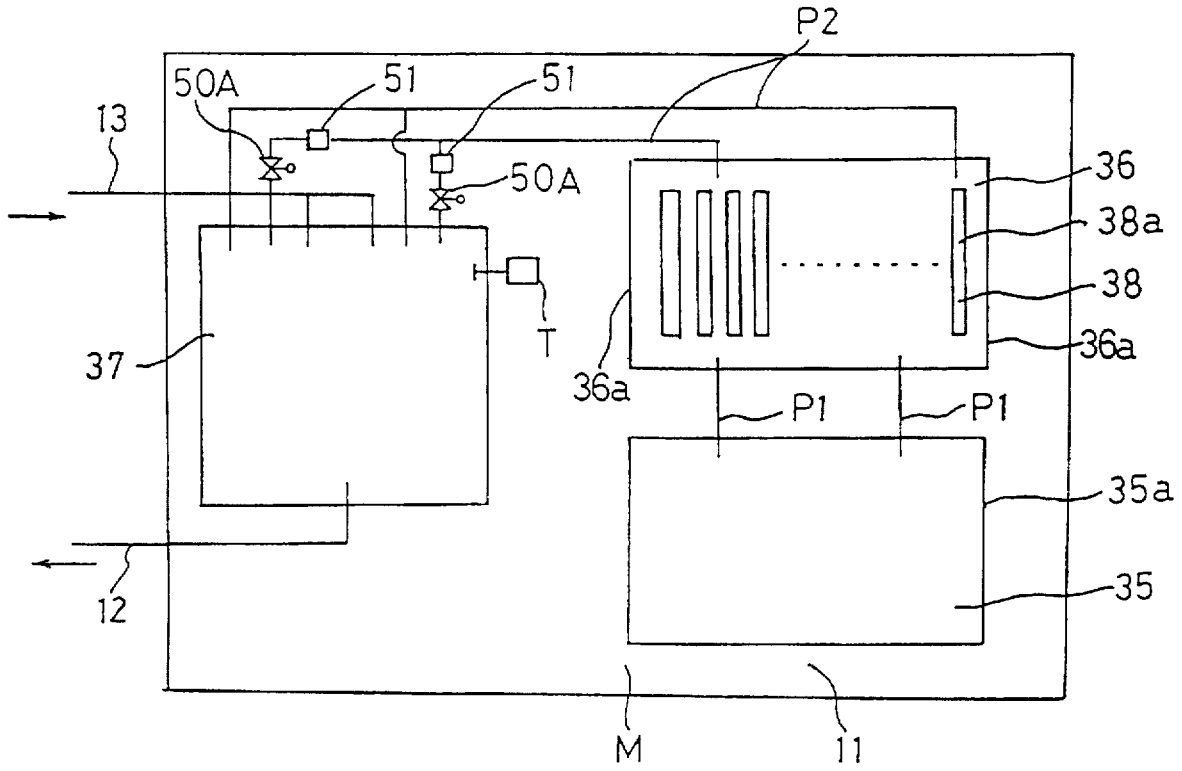
FIG. 6 is a circuit diagram of the second embodiment of showcase according to the invention.

The second embodiment of the invention is shown in FIGS. 5 to 13, wherein FIG. 5 shows a showcase used in the second embodiment and FIG. 6 shows a cooling circuit diagram of refrigerating unit 11 used also in the same second embodiment.

Figure 7:
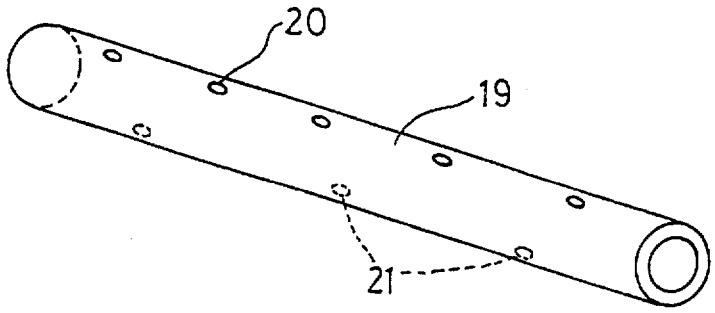
FIG. 7 is a perspective view of cooled air ejecting duct used in the showcase according to the invention.

As shown in FIG. 5, a cooled air passage 18 is located along the upper wall, the rear wall and the lower wall of goods display section 3. End portion 12*a* of a cooled air feeding pipe 12 passing through the rear wall of said showcase 1 is connected with the middle portion of said air passage 18. Cylindrical cooled air ejecting duct 19 made of adiabatic material such as urethane as shown in FIG. 7 is connected to said end portion 12*a* so as to be located horizontally in the width direction of said showcase 1 with a bending of 90 degrees. Said cooled air ejecting duct 19 has on its upper surface a plurality of ejecting holes 20 formed so as to eject upwards cooled air fed through said feeding pipe 12 and has on its lower surface a plurality of discharge holes 21 formed so as to eject cooled air downwards as well as to discharge water from said ejecting duct 19.

Cooled air ejecting ports 22 are located at the front upper end of said air passage 18 for ejecting cooled air downwards in the front side of said goods display section 3, while a cooled air absorbing port 23 is located at the lower end of the front side of said goods display section 3 so as to open into the lower front end of said air passage 18. A baffle plate 24 is located on the side of said air absorbing port 23 far from said cooled air ejecting duct 19, and a fan 25 is set on said baffle plate 24 for ventilating said air passage 18.

End portion 13*a* of an cooled air collecting pipe 13 is located so as to pass through the rear wall of said showcase 1 at the intermediate position between said fan 25 and said end portion 12*a* of said feeding pipe 12. A cylindrical cooled air collecting duct not shown made of adiabatic material such as urethane is connected to said end portion 13*a* so as to be located horizontally in the width direction of said showcase 1 with a bending of 90 degrees. This air collecting duct has on its underside surface a plurality of air absorbing holes, said holes having a hole surface equivalent to the total hole surface of said cooled air ejecting ports 20 and said discharge holes 21 on said cooled air ejecting duct 19.

Said cooled air ejecting duct 19 and said air collecting duct can be similarly connected respectively to said end portion 12*a* of feeding pipe 12 and said end portion 13*a* of said air collecting pipe 13 described in said first embodiment.

An air guide passage 26 is located along and on the rear side of said cooling air passage 18. A guide air ejecting port 27 is located at the upper front end of said air guide passage 26 so as to open in front of and adjacent to said ejecting port 22 for ejecting downwards cooled air from said guide passage 26, while a guide air absorbing port 28 is located at the lower front end of said air guide passage 26 so as to open in front of and adjacent to said absorbing port 23 for absorbing cooled air flowing in said goods display section 3. Further, a fan 30 for guide air venting is supported on a supporting plate 29 adjacent to said guide air absorbing port 28. Said air guide passage 26 may be omitted depending on the type of showcase 1.

An outer air passage 31 is located above the top end of said air guide passage 26, and an outer air ejecting port 32 is formed at the front end of said outer air passage 31 adjacent to said guide air ejecting port 27 for ejecting downwards outer air fed from said outer air passage 31. A fan 33 for sucking outer air into said outer air passage 31 is located on the top plate of said showcase 1.

A detector 34 consisting of thermostat T for temperature control of said goods display section 3 is located at the rear top end of this section 3.

Said feeding pipe 12 and said collecting pipe 13 have respectively thereon manually operated control valves 49 as air flow control means for controlling the opening of said pipes 12,13 so as to approximately equalize the flow rates of fed air and collected air based on determining of internal pressures in said pipes before starting the operation of refrigerating device, and automatic closing valves 50 as automatic cooled air controlling means driven by a motor Mo connected to said thermostat T located within said showcase 1. When temperature in said showcase 1 detected by said detector 34 of thermostat T located in said showcase 1 is increased over a predetermined upper-limit temperature, said closing valves 50 of said feeding pipe 12 and said collecting pipe 13 are simultaneously opened, while on the other hand when said thermostat T has detected a predetermined lower-limit temperature, said closing valves 50 are simultaneously closed. Said manually controlled opening control valve 49 and said automatic closing valves 50 interlocked with said thermostat T in said showcase 1 can be together replaced by an automatic opening control valve connected with said motor M constructed as a step-motor for carrying out both valve opening control function and valve closing function. Further, said opening control valves 49 and said closing valves 50 may be located within said showcases 1.

As shown in FIG. 6, a refrigerating unit 11 for refrigerating said goods containing box 5 in said showcase 1 is installed in a machinery room M separated from shop S having showcases 1 therein installed.

This refrigerating unit 11 consists of a casing 35 containing refrigerating cycle 35 comprising a compressor, a condenser, expansion members and an evaporator, a cold storage tank 36 for keeping brine cooled by said refrigerating cycle 35 in a cool state and a cooled air generating chamber 37 for generating cooled air by heat exchange between said brine and surrounding medium to be cooled passing through a heat-exchanger 39. In this case, said condenser in said refrigerating cycle 35 is separately located as in cooling tower on the roof of said refrigerating unit 11 and the like.

In said refrigerating unit 11, various equipments constituting said refrigerating cycle 35 such as compressor, condenser, expansion members and evaporator are connected each other through two pipings not shown in the drawings, while said refrigerating cycle 35 and said cold storage tank 36 containing therein a plurality of cold storage members 38 are connected each other through pipings P1, P1 for circulating brine, and further said cold storage tank 36 and respective heat exchangers 39 in said cooled air generating chamber 37 are connected through two pipings P2, P2 for circulating brine. A pump not shown in drawings serves to circulate brine through said casing 35*a*, said cold storage tank 36 and said cooled air generating chamber 37.

Said refrigerating unit 11 is now described in more details.

For the purpose of cooling said brine as refrigerating medium in said refrigerating cycle 35, said brine comes into contact with a not-shown evaporator of the cycle 35 for heat exchange in said casing 35*a*. In this embodiment, it is preferable to use calcium chloride having a characteristic of becoming hardly viscous or ethylene glycol solution as brine.

In said cold storage tank 36 which is connected to said refrigerating cycle 35 through 2 pipings P1, P1 for circulating brine, there are arranged in parallel a plurality of cold storage vessels 38*a* which enclose each a solution of ethylene glycol mixed with water so as to obtain a liquid having a little higher freezing point (−30 to −40 degrees centigrade). Aligning direction of said cold storage vessel 38*a* is parallel to the opposing side surface 36*a*,36*a* receiving said pipings P1 and P2 for the purpose of accelerating the flow of brine through said casing 35*a*, said cold storage tank 36 and said cooled air generating chamber 37. Further, polyprene glycol, sodium chloride, magnesium chloride and the like can be used as brine in addition to said calcium chloride or ethylene glycol.

Said cold storage tank 36 is connected with a heat exchanger 39 through two pipings P2, P2, and said pipings P2 have respectively thereon a closing valve 50A automatically closed by a not-shown motor connected with said thermostat T placed in a cooled air collecting chamber 41 and a pump 51 for circulating cooled brine in said cold storage tank 36. When temperature of generated cooled air detected by said thermostat T located in said cooled air collecting chamber 41 is increased above an upper-limit set temperature, said closing valve 50A is opened and said pump 51 is started on said piping P2, while when said thermostat T detects a lower-limit set temperature, said closing valve 50A is closed and said pump 51 is stopped on said piping P2.

Figure 8:
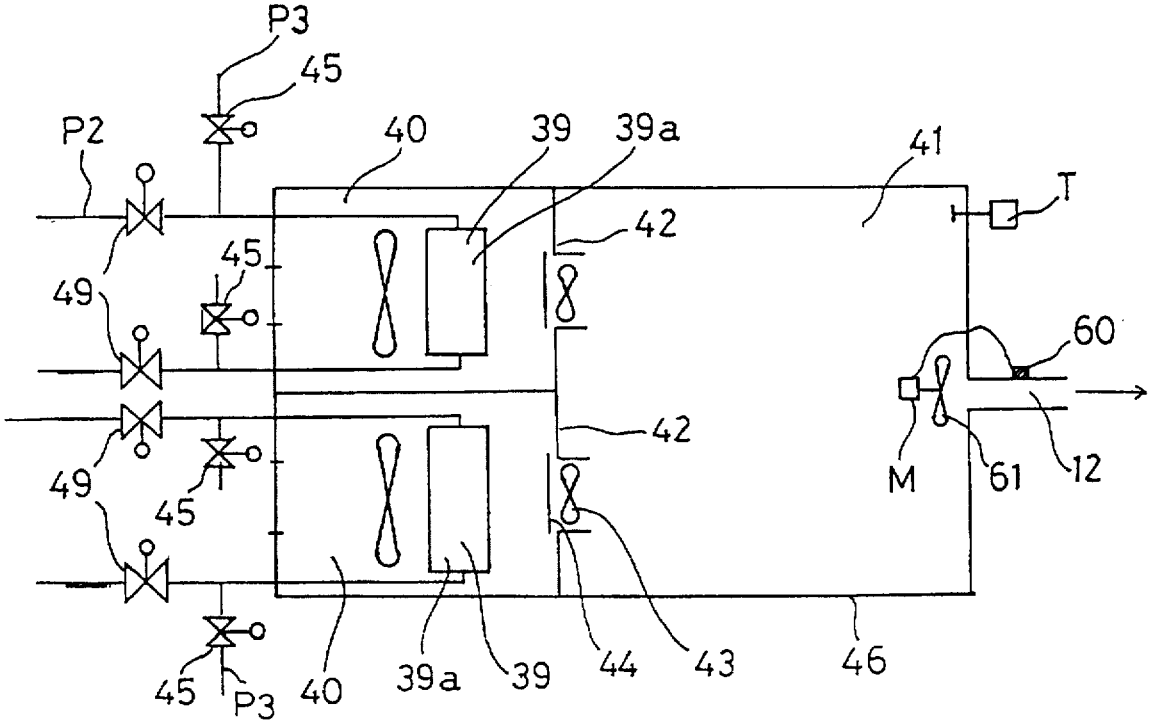
FIG. 8 is a circuit diagram of cooled air generating chamber according to the invention.

Further in said cooled air generating chamber 37, two heat exchanging chambers 40 having respectively fin coils 39*a* for circulating said brine are located as shown in FIG. 8. Said heat exchanging chambers 40,40 are separated from said cool air collecting chamber 41 by a bulkhead 42, and a fan 43 for venting cooled air is formed on said bulkhead 42. Said fan 43 has thereon a remote controlled shutter 44 for shutting venting between said heat exchanging chambers 40 and said cooled air collecting chamber 41.

Cooled air generated from said heat exchanging chambers 40,40 are collected into said cooled air collecting chamber 41 by means of said fan 43.

It is possible to drive simultaneously said heat exchangers 39 in said both chambers 40, but it is more preferable according to the invention to use a heat exchanger 39 in either one of said heat exchanging chambers 40,40 and to carrying out defrosting operation on the heat exchanger 39 in the other heat exchanging chamber 40 or to leave said other heat exchanger 39 in the standby state, thereby to use alternatively said two heat exchanging chambers 40.

At said defrosting operation, it is possible to close said shutter 44 thereby to prevent warmer air generating at this defrosting operation from intruding into said cooled air collecting chamber 41.

A piping P3 for supplying and collecting hot brine is located on said piping P2, and a valve 45 on said piping P3 for defrosting use can be opened for carrying out the defrosting operation. Calcium chloride as brine is filled in said piping P3, and this brine is subjected to heat exchange with high temperature—high pressure coolant gas before said condenser in said refrigerating cycle 35, thereby to be heated up to about 40 degrees. Further, the temperature control of said brine can be carried out by providing a bypass in said piping P3. Said valve 45 of defrosting use can be replaced by a three-way valve combining said defrosting valve 45 and a manually operated closing valve 49.

Said feeding pipe 12 is connected between said cooled air collecting chamber 40 and said goods display section 3 of said showcase 1 for feeding cooled air contained in said chamber 41 into said latter section 3. Said end portion 12*a* of said feeding piping 12 communicates with said cooled air passage 18 in said respective showcases 1.

A venting sensor 60 is located on said feeding piping 12 at the point approximate to said cooled air collecting chamber 41 for invertor driving a motor Mo of said fan 61 only when the flow rate of cooled air is below a predetermined value, thereby to preventing the overcharge of said motor Mo.

Further, said collecting pipe 13 is connected with said heat exchange chamber 40 of said cooled air generating chamber 37 for recycling warmed air from said goods containing box 5 to said cooled air generating chamber 37 of said refrigerating unit 11. For establishing such a circulation of cooled air between said feeding pipe 12 and collecting pipe 13, fan or fans of large capacities not shown are located in said refrigerating unit 11 except said fan 43.

Figure 9:
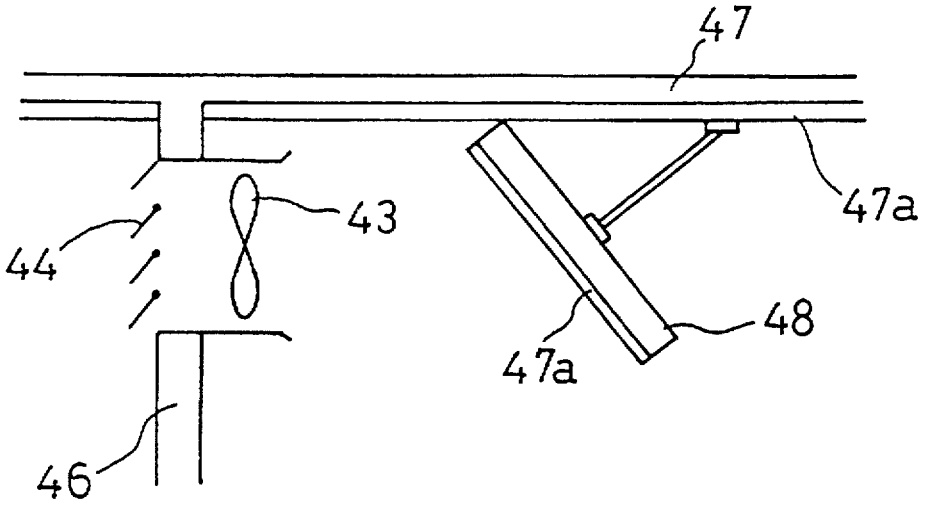
FIG. 9 is a diagram showing the relation between fan and baffle plate or deflector in a cooled air collecting chamber.

Surrounding walls 46 of said cooled air generating chamber 37 are formed by adiabatic panels, and the ceiling of said chamber 37 is covered by ceramic plate 47*a* for preventing frosting as shown in FIG. 9. Since the ceramic material of said ceramic plate 47*a* has such characteristics as to prevent development of ice crystals contained in cooled air striking the same, frosting on said ceiling 47 is prevented. Said ceiling 47 has also an inclined baffle plate 48 attached thereto for receiving cooled air blown through said fan 43 located on said bulkhead 42, thereby to prevent frosting on other internal surfaces other than said ceiling 47.

Further, said cooled air collecting chamber 41 has therein said thermostat T for detecting temperature of generated cooled air thereby to drive said closing valve 50A and said pump 51.

As describe above, said feeding pipe 12 and said collecting pipe 13 consist respectively of a number of adiabatic vent pipes 14 having the same structure of those used in the first embodiment. However, said adiabatic vent pipes 14 of said feeding pipe 12 do not use any metallic members such as stainless steel as their cylindrical cores 16 for the purpose of preventing frosting.

Figure 10:
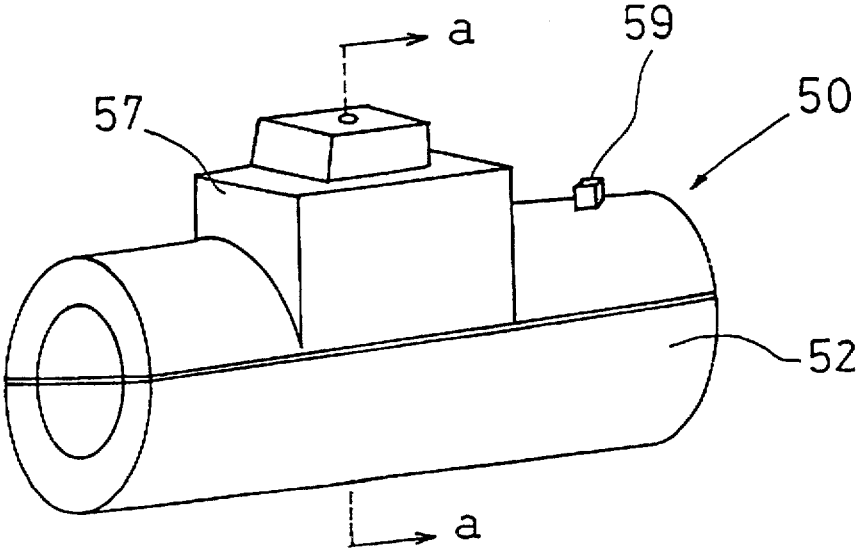
FIG. 10 is a perspective view of a air flow controlling damper or closing valve.
Figure 11:
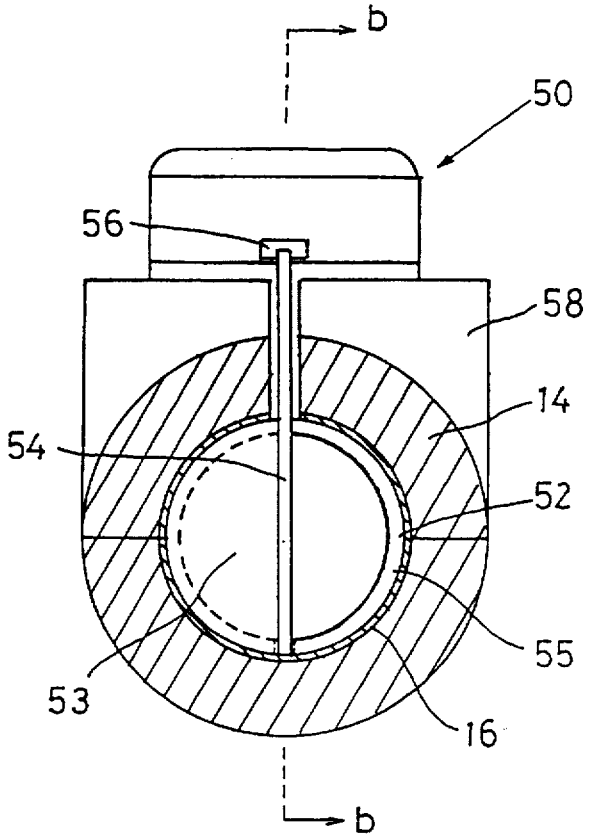
FIG. 11 is a cross section taken along line a—a in FIG. 10.
Figure 12:
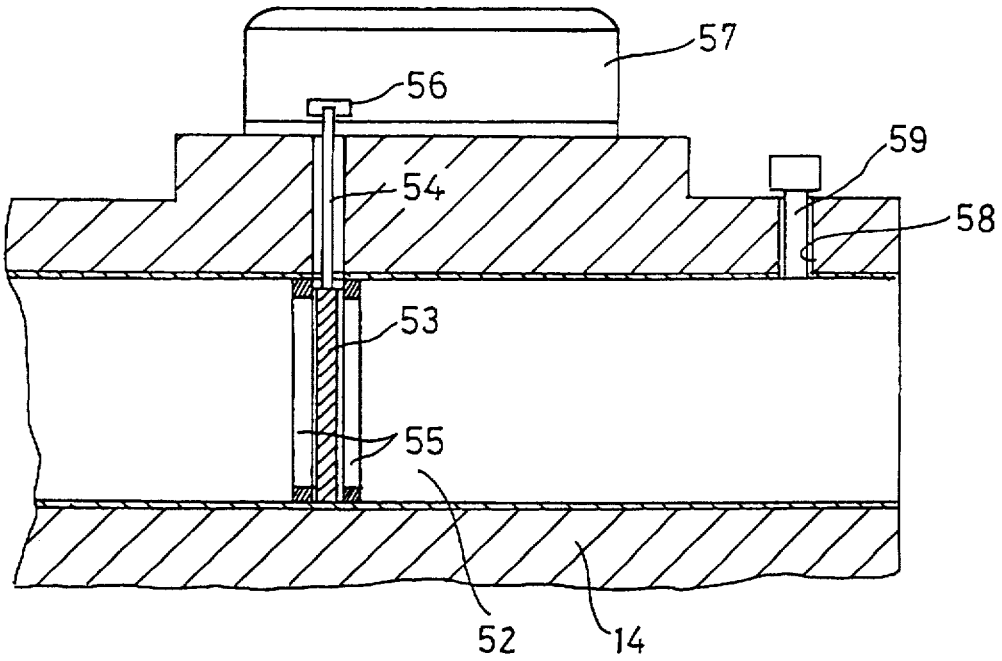
FIG. 12 is a longitudinal cross section taken along line b—b in FIG. 11.
Figure 13:
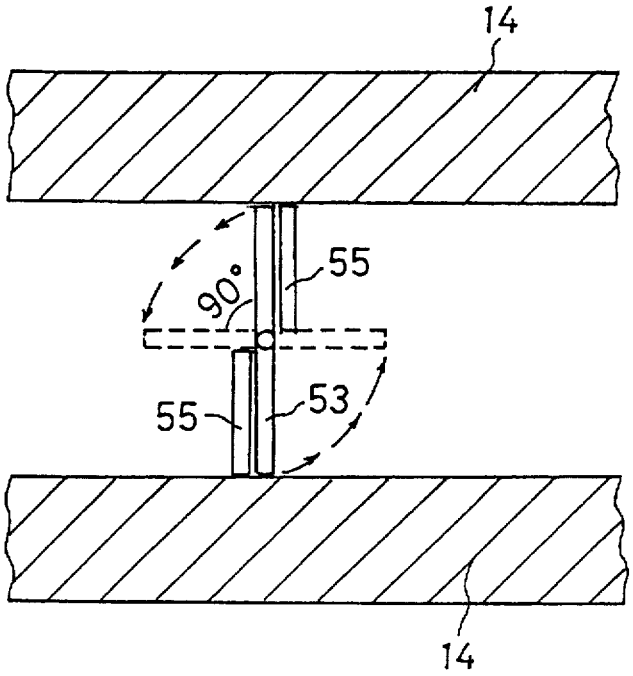
FIG. 13 is a plan diagram showing the rotation of valve plate.

FIG. 10 is a perspective view of said closing valve 50, FIG. 11 being a cross sectional view taken along the line a—a of FIG. 10, and FIG. 12 being a longitudinal sectional view taken along the line b—b of FIG. 11, respectively.

Valve body 52 of said closing valve 50 is mounted on the internal surface of said adiabatic vent pipe 14, and said valve body 52 has therein equipped with a circular valve plate 53 for closing said adiabatic vent pipe 14 and shutting off venting therein, said valve plate 53 being mounted rotatably in a horizontal direction on an insulation shaft 54 as described above. Two circular valve seats 55 are located on the inner surface of said adiabatic vent pipe 14, one valve seat 55 resting on one of circular portions of said valve plate 53 from the side of said valve plate 53, and the other valve seat 55 resting on the other circular portion of said valve plate 53 from the other side of said valve plate 53. Said circular valve seats 55 play the role of stoppers for stopping the rotation of said valve plate 53 at about 90 degrees on the opening of said valve plate 53, while having the function of shutting air flow around said valve plate 53 by abutting against the circumferential portion of said valve plate 53 together with the function of seal members for preventing the freezing of said valve plate 53 due to the cooling air supplied from said showcase 1.

Said insulation shaft 54 extends above from the top of said valve plate 53 into and through said valve body 52, and has a driving shaft 56 of said motor connected at the top thereof. Said insulation shaft 54 and said driving shaft 56 are accommodated in a motor mounting table 57 of adiabatic material having a cross section of substantially square form.

Further, said adiabatic vent pipe 14 has a half construction consisting of upper and lower halves at the point where said closing valve 50 is set thereon, and these halves are bonded to each other to form a circular cross section after said valve plate 53 and the like have been mounted into said adiabatic vent pipe 14.

A small hole opening into the center of duct as flow rate detecting port 58 is located near said motor mounting table 57. An air flow meter is inserted from said port 58 into said duct 14 to detect air flow capacity and velocity therein. On the basis of this flow air detection, a duct opening regulation valve 49 located in said duct is manually controlled to obtain an appropriate supplying and collecting capacity of cooled air. After this appropriate setting of said regulation valve 49, said flow rate detecting port 58 is usually closed by a suitable plug 59.

Said insulation shaft and other members constituting said closing valve 50 is formed from adiabatic materials of low heat transfer coefficient such as urethane, polyester and the like.

The operation of the embodiment described above is as follows:

Liquid coolant in low temperature/low pressure state in said refrigerating cycle 35 of said refrigerating unit 11 is first fed into a not-shown evaporator, wherein said coolant is forced to come into contact with brine, so that calcium chloride as brine is cooled up to −40 to −50 degrees centigrade. Brine thus cooled is circulated into a cold storage tank 36 through piping P1 for cold storage therein.

Calcium chloride solution thus cooled freezes a mixture of ethylene glycol and water which has been beforehand regulated so as to freeze at −30 to −40 degrees centigrade, i.e. at a little higher freezing point than that of calcium chloride contained in said cold storage vessels 38*a*. Therefore, when said calcium chloride as brine has been a little warmed through circulation thereof, said cold storage vessels 38*a* take the role of cold storage members 38 for cooling said brine down to −40 to −50 degrees centigrade. Therefore, there is no need to continuously drive said refrigerating cycle 35. In other words, only in the case where said calcium chloride solution becomes so warm that it can not generate cooled air of predetermined temperature in said cool air generator 37, said refrigerating cycle 35 is driven for cooling calcium chloride solution while operating said closing valve 50 in said piping P2 for circulation of said solution. Said mixture of ethylene glycol and water in said cold storage vessels 38*a* can be freezed by using the midnight electricity of low price, and, at the day time, said refrigerating cycle 35 is driven only when the temperature of brine becomes lower than the predetermined temperature.

Cooled air collected from each showcase 1 through said collecting piping 13 into said cold air collecting chamber 41 is cooled then by heat exchanging with brine passing through said cooling fin coils 39*a* located in said cooled air generating chamber 37, and air thus recooled is fed into said feeding piping 12 by means of a fan not shown in said refrigerating unit 11. Cooled air fed into piping 12 is ejected through said ejecting duct 39 evenly into said cooled air passage 18 and then from said ejecting port 7 into said goods display section 3. Since said cooled air ejecting port 7 is located at the upper front edge of said showcase 1, it descends downwards from the upper portion of said goods display section 3, while cooling this section 3 and goods contained therein. Cooled air used for goods refrigerating is absorbed through said absorbing port 9 located at said goods containing box 5 into said collecting piping 13 by means of another fan located in said refrigerating unit 11, and then into said refrigerating unit 11.

As described above, cooled air is forced to circulate through said feeding piping 12 and said collecting pipe 13 each consisting of adiabatic vent ducts 14, 14*a* for cooling goods arranged in said goods display section 5 to a predetermined temperature. On the other hand, air used for cooling is absorbed from said absorbing port 9*a* into said cooled air passage 18 by a fan 25 and can be reused as cooled air after mixing with fresh cooled air fed from said feeding piping 12 into said cooled air passage 18.

Guide air ejecting port 7*b* and outer air ejecting port 7*c* located at the front portion of upper wall 6 of said goods display section 3 eject respectively guide air and outer air as air curtain for assuring the balance between pressures of cooled air and outer air. Said guide air and its surrounding air is absorbed through said guide air absorbing port 9*b* located at the front portion of lower wall 8 in said goods display section 3 into said guide air passage 26 by means of said fan 30 to be fed again from said guide air ejecting port 27 as guide air after passing through said guide air passage 26.

Further, it is to be noted that due to the opening control of said feeding pipe 12 and said collecting pipe 13 by means of said duct opening regulation valve 49, feeding capacity and collecting capacity of said cooled air is approximately equal to each other, and balance between pressures of outer air and cooled air is adjusted with said guide air as said air curtain ejected in front of said showcase 1.

Once temperature in said showcase 1 descends down to the predetermined lower limit temperature while driving said refrigerating cycle 35 in said refrigerating unit 11, venting through said adiabatic vent pipe 14 is closed by stopping driving of said motor M located on said feeding piping 12 and said collecting piping 13 and connected to said thermostat T for controlling the temperature in said showcase 1 thereby to force said valve plate 55 to abut onto said valve seats 55. On the other hand, when the temperature in said showcase 1 increases above the predetermined upper limit temperature, said motor Mo is driven thereby to rotate said valve plate 53 of said closing valve 50 by about 90 degrees for establishing venting of said adiabatic vent pipe 14 and for feeding cooled air into showcase 1 while collecting cooled air used in said showcase 1.

In this second embodiment of the invention, by providing two set of refrigerating units 11, one for foodstuff freezing and another for joint use as foodstuff freezer and refrigerator as described in the first embodiment, cooled air of desired temperature can be generated and introduced into desired showcase 1 through feeding piping 12 thereby to desirably use said showcase 1 as freezer or refrigerator.

It is possible to shift said showcases 1 to desired position and to lay simply said adiabatic vent pipe 14, 14A connecting said refrigerating unit 11 in said machinery room M with said showcase 1 in said showcases in said shop S.

Further, said refrigerating cycles 35 in respective showcases 1 have been assembled in said machinery room M as a unit, so that the number of manufacturing parts of said showcase 1 itself is decreased thereby to attain a lower manufacturing cost. The simple construction of showcase itself thus obtained permits a smaller installation space thereof thereby to render possible the more efficient utilization of sale floor surface of said shop S.

Further, concentration of refrigerating cycle into the machinery room M eliminates the need of laying coolant pipes, drain pipes and electrical distribution lines for each showcase, so that it is possible to reduce the equipment cost and also the running cost such as the operation maintenance cost for preventing any troubles. Laying of coolant pipes is constantly set in machinery room M, so that there is no risk of gas leakage at the shift of showcases 1 as in the conventional shops, and since there is fewer connection points due to considerably shorter lengths of coolant pipes, gas leakage is further reduced.

Further, a considerable length of coolant piping has been necessary for the heretofore known refrigerating device, for example for a coolant piping of 80 meters, a capacity loss of about 30% had to be anticipated for a driving force of refrigerating device less than 10 horse powers. On the other hand, the refrigerating device according to the embodiment has a design of compact sizes and less pressure loss of pipings without need of capacity loss.

The defrosting operation in each showcase is not necessary due to concentrated control in machinery room M, so that a better temperature control in showcases is obtained with no risk of "dripping" and with better quality control of goods.

By using midnight electricity for cooling brine to be used and using said cold storage vessels 38*a* thus freezed as cold storage members 38 for brine, it is not necessary to continuously drive said refrigerating cycle 35 thereby to decrease the total cost of electricity to 40–50% of that of heretofore known showcases.

Further, the heat exchanging between brine and water using fin coils 39*a* for generating of cooled air allows for a higher heat exchanging coefficient, so that the evaporator heretofore used can be reduced in size to about ⅓.

In the second embodiment each valve plate 53 of the closing valves 50 of said feeding pipe 12 and said collecting pipe 13 rotates 90 degrees only to open or shut the opening of the pipes 12,13. But it is possible to rotate each of said valve plate 53 of said closing valves 50 of said feeding pipe 12 and said collecting pipe 13 within 90 degrees to change an opening degree of said opening widely or narrowly by said step-motor Mo corresponding to the temperature in each of said showcases 1.

By this construction, once temperature in said showcase 1 descends down to the predetermined lower limit temperature while driving said refrigerating cycle 35 in said refrigerating unit 11, the opening degree of the opening is closed narrowly by rotating the valve plate 53 of the closing valves 50 of the feeding pipe 12 and the collecting pipe 13 by driving the step-motor Mo. Then the supplying and collecting volume of cooled air into and out from the showcase 1 are reduced in quantity and the temperature in the showcase 1 begins to increase slightly little by little.

On the other hand, when the temperature in said showcase 1 increases above the predetermined upper limit temperature 1 while driving said refrigerating cycle 35 in said refrigerating unit 11, the opening degree of the opening is opened widely by rotating the valve plate 53 of the closing valves 50 of the feeding pipe 12 and the collecting pipe 13 by driving the step-motor Mo. Then the supplying and collecting volume of cooled air into and out from the showcase 1 are gained in quantity and the temperature in the showcase 1 begins to descend slightly little by little.

In this embodiment of the invention, it is possible to control the temperature in the showcase 1 within 1 degree.

Figure 14:
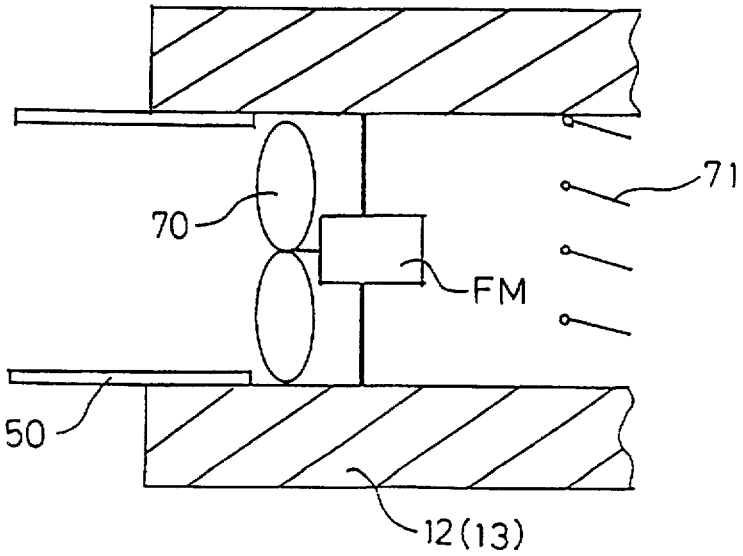
FIG. 14 is a cross section view of piping of the other embodiment of the invention.

FIG. 14 shows the other embodiment of the invention instead of rotating each of said valve plate 53 of said closing valves 50 of said feeding pipe 12 and said collecting pipe 13 within 90 degrees to change an opening degree of said opening widely or narrowly by said step-motor Mo corresponding to the temperature in each of said showcases 1.

In said feeding pipe 12 and said collecting pipe 13 for each of said showcase 1 there are no closing valves 50 but there provided a fun 70 which is driven by a motor FM. Said motor FM is connected to a thermostat in corresponding showcase and controlled by an inverter. Accordingly, the number of rotation of said motor FM can be changed corresponding to the temperature in each of said showcases.

In said feeding pipe 12 and said collecting pipe 13 for each of said showcase 1 there provided a remote controlled shutter 71 near the fun 70 for shutting said feeding pipe 12 and said collecting pipe 13 when said fun 70 is not driven.

By this construction, once temperature in a showcase descends down to the predetermined lower limit temperature while driving said refrigerating cycle 35 (FIG. 4) in said refrigerating unit 11 (FIG. 1), the number of rotation of said motor FM is decreased. Then the supplying and collecting volume of cooled air into and out from the showcase by rotating of said fun 70 are reduced in quantity and the temperature in the showcase begins to increase slightly little by little.

On the other hand, when the temperature in a showcase increases above the predetermined upper limit temperature while driving said refrigerating cycle 35 in said refrigerating unit 11, the number of rotation of said motor FM is increased. Then the supplying and collecting volume of cooled air into and out from the showcase by rotating of said fun 70 are gained in quantity and the temperature in the showcase begins to descend slightly little by little.

In this embodiment of the invention, it is possible to control the temperature in the showcase within 1 degree.

The invention is not limited to the above described embodiments. For example, the invention is not limited to the open showcases as described above, but it can be applied to cooling of vending machines or of closed type of showcases having front doors. It is to be noted that two set of said refrigerating chambers are not necessarily used in the refrigerating devices of said vending machines.

The advantages obtained according to the invention is that a number of refrigerating equipments can be concentrated into a single machinery room, that no pressure loss is caused in coolant pipings of refrigerating devices, and that cold storage of brine can be carried out by utilizing of midnight electricity thereby to reduce the total necessary electricity by 40–50%. Further, when using the refrigerating devices according to the invention are used as showcases, the laying operation of coolant pipings, electric works or drain pipe works is not necessary in shops, and shifting of showcases in shops and the following piping works can be easily carried out. Since cooled air is circulated between refrigerating device and respective showcases, there is no danger of leakage of coolant in the pipings, which is a factor contributing to the environmental protection.

Further, since showcases and vending machines with a simplified construction can increase the goods capacity for a same occupying space thereof and can decrease the occupying floor space thereof for a same goods capacity, thereby to deliver a larger sale floor space in the case of showcases. Defrosting operation is not necessary due to the concentration of refrigerating devices into a single refrigerating unit in said machinery room, so that freshness control of goods contained is improved.

Furthermore, the number of refrigerating parts, the frequency of faults and the running cost such as maintenance can be reduced.

What is claimed is:

1. Method for refrigerating open showcases comprising:

cooling air within a refrigerating unit to a temperature below a predetermined temperature in open showcases and feeding said cooled air as refrigerating source into said open showcases through feeding piping;

mixing said cooled air with air in said open showcases thereby to carry out refrigerating in said open showcases;

collecting said cooled air mixed with said air in said showcases in the same quantity of said cooled air fed into said open showcases as refrigerating source through collecting piping back into said refrigerating unit;

cooling said collected cooled air mixed with said air in said refrigerating unit for using again as refrigerating source in said open showcases;

controlling each of automatically air flow volume regulating means provided respectively in the feeding side and in the collecting side of each showcase corresponding to the temperature in each of said open showcases; and automatically regulating supplying of said cooled air and collecting volume of said cooled air mixed with said air proportionally;

thereby preventing the leakage of said cooled air from said open showcases.

2. Refrigerating device for open showcases comprising:

a plurality of open showcases having respectively cooled air ejecting port and cooled air absorbing port;

a refrigerating unit located separately from said showcases and consisting of a refrigerating cycle having a compressor, a condenser, expansion members and an evaporator;

a feeding piping for feeding cooled air generated from said refrigerating unit into said respective showcases through said cooled air ejecting port;

a collecting piping for collecting said cooled air from said respective showcases through said cooled air absorbing port thereof back into said refrigerating unit; and a automatically means for regulating feeding and collecting of said cooled air such that a quantity of cooled air fed into said respective showcases is equal to a quantity of cooled air collected from said respective showcases.

3. Refrigerating device of showcases described in claim 2, wherein said feeding piping and said collecting piping are consisted respectively of cylindrical adiabatic vent pipes, pairs of adjacent adiabatic vent pipes connected by means of connecting members inserted respectively into edge portions of said adjacent adiabatic vent pipes.

4. Refrigerating device of showcases described in claim 3, wherein said regulating means comprises at least a valve means having duct opening regulation function provided in said feeding and collecting piping for regulating the opening degree of said respective pipings in order to fix the venting capacity of said cooled air to be fed and said cooled air to be collected to predetermined values, and flow rate controlling function for automatically controlling the flow rate of ducts by means of temperature controlling devices located in said respective showcases.

5. Refrigerating device comprising:

a plurality of open showcases having respectively cooled air ejecting port or ports and cooled air absorbing port or ports;

a refrigerating unit located separately from said open showcases and consisting of a refrigerating cycle having a compressor, a condenser, expansion members and an evaporator, of cold storage tank for cold storing of circulated brine, and of a cooled air generating chambers having each heat exchangers therein for heat exchanging said cold brine stored in said cold storage tank with air thereby to generate cooled air for respective open showcases;

a feeding piping for feeding cooled air generated from said refrigerating unit into said respective open showcases through said cooled air ejecting port;

a collecting piping for collecting said cooled air from said respective open showcases through said heat exchangers in said cooled air generating chamber; and a regulating means for regulating feeding and collecting of said cooled air such that a quantity of cooled air fed into said respective open showcases is equal to a quantity of cooled air collected from said respective open showcases, said regulating means comprising:

opening and shutting means provided in each of said feeding piping and said collecting piping and regulating the opening degree of said feeding piping or said collecting piping for presetting the feeding cooled air volume or the collecting cooled air volume fixed; and at least one automatically air flow capacity regulating device provided respectively in the feeding side and in the collecting side of each open showcase to regulate supplying and collecting volume of cooled air proportionally by means of temperature controlling devices located in said respective open showcases;

thereby preventing the leakage of said cooled air from said open showcases.

6. Refrigerating device of showcases described in claim 5, wherein sealed vessels for sealing freezable brine therein are provided in said cold storage tank.

7. Refrigerating device for showcases comprising:

a plurality of showcases having respectively cooled air ejecting port or ports and cooled air absorbing port or ports;

a refrigerating unit located separately from said showcases and consisting of a refrigerating cycle having a compressor, a condenser, expansion members and an evaporator, of cold storage tank for cold storing of circulated brine, and of a cooled air generating chambers having each heat exchangers therein for heat exchangers said cold brine stored in said cold storage tank with air thereby to generate cooled air for respective open showcases;

a feeding piping for feeding cooled air generated from said refrigerating unit into said respective open showcases through said cooled air ejecting port; and a collecting piping for collecting said cooled air from said respective open showcases through said heat exchangers in said cooled air generating chamber; and wherein;

sealed vessels for sealing freezable brine therein are provided in said cold storage tank;

said feeding piping and said collecting piping consist respectively of cylindrical adiabatic vent pipes, pairs of adjacent adiabatic vent pipes connected by means of connecting members inserted respectively into edge portions of said adjacent adiabatic vent pipes;

said feeding piping and said collecting piping have respectively thereon at least a valve having duct opening regulation function for regulating the opening degree of said respective piping in order to fix the venting capacity of said cooled air to be fed and said cooled air to be collected to predetermined values, and flow rate controlling function for automatically controlling the flow rate of ducts by means of temperature controlling devices located in said respective showcases;

said cooled air generating chambers has therein two heat exchanging chambers independent to each other, said respective heat exchanging chambers having therein said heat exchangers and have thereto connected said collecting piping, whereby said cold brine for refrigerating use and hot brine for defrosting use are selecting introduced into said heat exchangers.

8. Refrigerating device for vending machines with a goods taking-out opening, said refrigerating device comprising:

a plurality of vending machines having respectively a goods taking-out opening and cooled air ejecting port and cooled air absorbing port;

a refrigerating unit located separately from said vending machines and having a compressor, a condenser, expansion members and an evaporator so as to form a refrigerating cycle;

a feeding piping for feeding cooled air generated from said refrigerating unit into said respective vending machines through said cooled air ejecting port;

a collecting piping for collecting said cooled air from said respective vending machines through said cooled air absorbing port thereof into said refrigerating unit; and a regulating means for regulating feeding and collecting of said cooled air such that a quality of air fed into said respective vending machines is equal to a quantity of cooled air collected from said respective vending machines, said regulating means comprising at least a valve means provided in said feeding and collecting piping having duct opening regulation function for regulating the opening degree of said respective pipings in order to fix the venting capacity of said cooled air to be fed and said cooled air to be collected to be equal predetermined values, and flow rate controlling function for automatically controlling the flow rate of said cooled air by means of temperature controlling devices located in each of said vending machines;

thereby preventing the leakage of said cooled air from said goods taking-out.

9. Open showcase comprising:

a goods display section on the inside of an open goods taking-out opening;

a cooled air feeding port communicating with said goods display section for feeding cooled air from outside into said goods display section; and a cooled air collecting port communicating with said goods display section for collecting said cooled air in an amount as fed into said goods display section in order to exhaust it outwards thereby to prevent the leakage of said cooled air from said goods taking-out opening; and further comprising:

air flow rate controlling means for substantially equalizing respective flow rates of cooled air fed from said cooled air feeding port and of cooled air collected from said cooled air collecting port; and an automatic controlling means of cooled air circulation while comparing the temperature in said goods display section with respect to a predetermined temperature;

to thereby stop the feeding of cooled air to said cooled air to said cooled air feeding port and the collecting of cooled air from said cooled air collecting port when said temperature in said goods display section has fallen below said predetermined temperature as well as to start again the feeding of cooled air to said cooled air feeding port and the collecting of cooled air from said cooled air collecting port when said temperature in said goods display section has arisen above said predetermined temperature.

10. Vending machines comprising:

a goods containing box formed with an inside of goods taking out opening in its opening condition;

a cooled air feeding port communicating with said goods containing box for feeding cooled air from outside into said goods containing box;

a cooled air collecting port communicating with said goods display section for collecting said cooled air in order to exhaust it outwards; and a automatically means for regulating feeding and collecting of said cooled air such that a quantity of cooled air fed into said good containing box is equal to a quantity of cooled air collected from said goods containing box;

thereby preventing the leakage of said cooled air from said goods taking-out opening.

11. Vending machines described in claim 10, wherein said regulating means comprises:

air flow rate controlling means for substantially equalizing respective flow rates of cooled air fed from said cooled air feeding port and of cooled air collected from said cooled air collecting port;

and an automatic controlling means of cooled air circulation while comparing the temperature in said goods containing box with respect to a predetermined temperature;

whereby to stop the feeding of cooled air to said cooled air feeding port and the collecting of cooled air from said cooled air collecting port when said temperature in said goods display section has fallen below said predetermined temperature as well as to start again the feeding of cooled air to said cooled air feeding port and the collecting of cooled air from said cooled air collecting port when said temperature in said goods display section has arisen above said predetermined temperature.

12. Refrigerating device for showcases comprising:

a plurality of showcases having respectively cooled air ejecting port and cooled air absorbing part;

a refrigerating unit located separately from said showcases and consisting of a refrigerating cycle having a compressor, a condenser, expansion members and an evaporator;

a feeding piping for feeding cooled air generated from said refrigerating unit into said respective showcases through said cooled air ejecting port; and a collecting piping for collecting said cooled air from said respective showcases through said cooled air absorbing port thereof back into said refrigerating unit; and wherein said refrigerating unit has therein two beat exchanging chambers independent to each, said respective heat exchanging chambers having therein said heat exchangers and have thereto connected said collecting piping, whereby cold brine for refrigerating use and hot brine for defrosting use are selectively introduced into said heat exchangers.

13. Refrigerating device of showcases described in claim 12, wherein said refrigerating unit has therein a cooled air collecting chamber located adjacent to each of said heat exchanging chambers via a bulkhead and connected to each of said feeding piping, and said bulkhead comprises an opening having shutters for selectively carrying out venting between said heat exchanging chamber and said cooled air collecting chamber.

* * * * *